US005101332A

United States Patent [19]

Hsia

[11] Patent Number: 5,101,332

[45] Date of Patent: Mar. 31, 1992

[54] RETRACTABLE DEVICE FOR A DESK LAMP

[76] Inventor: Wang Y. Hsia, P.O. Box 82-144, Taipei, Taiwan

[21] Appl. No.: 693,605

[22] Filed: Apr. 30, 1991

[51] Int. Cl.[5] ..... F21V 21/22

[52] U.S. Cl. ..... 362/401; 362/413; 362/418; 362/431

[58] Field of Search ..... 362/401, 410, 412, 413, 362/414, 418, 419, 431

[56] References Cited

U.S. PATENT DOCUMENTS

| | | | |
|---|---|---|---|
| 1,574,908 | 3/1926 | Lamp | 362/413 |
| 2,299,683 | 10/1942 | Curtis | 362/413 |
| 3,008,742 | 11/1961 | Goldstein | 362/431 |
| 4,488,209 | 12/1984 | Gosswiller | 362/431 |

FOREIGN PATENT DOCUMENTS

| | | | |
|---|---|---|---|
| 334418 | 9/1919 | Fed. Rep. of Germany | 362/418 |
| 812997 | 2/1937 | France | 362/413 |

*Primary Examiner*—Ira S. Lazarus
*Assistant Examiner*—Sue Hagarman
*Attorney, Agent, or Firm*—Alfred Lei

[57] ABSTRACT

This invention relates to a retractable device for a desk lamp and in particular to one which including a tubular cylindrical casing having an end for connecting with an appropriate position of the desk lamp, a piston rod provided with an outer end for connecting with an appropriate position of the desk lamp and extending into the cylindrical casing, an annular ring fixedly mounted within the cylindrical casing for receiving a first rubber ring, a cap engaged with the other end of the tubular cylindrical casing, a plug mounted at the other end of the tubular cylindrical casing, and a second rubber ring disposed between the cap and the plug.

1 Claim, 3 Drawing Sheets

RETRACTABLE DEVICE FOR A DESK LAMP

SUMMARY OF THE INVENTION

This invention relates to an retractable device for a desk lamp.

It is the primary object of the present invention to provide a retractable device for a desk lamp which is simple in construction.

It is another object of the present invention to provide a retractable device for a desk lamp which is economic to produce.

It is still another object of the present invention to provide a retractable device for a desk lamp which is easy to operate.

It is still another object of the present invention to provide a retractable device for a desk lamp which is fit for mass production.

It is a further object of the present invention to provide a retractable device for a desk lamp which is easy to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1A:
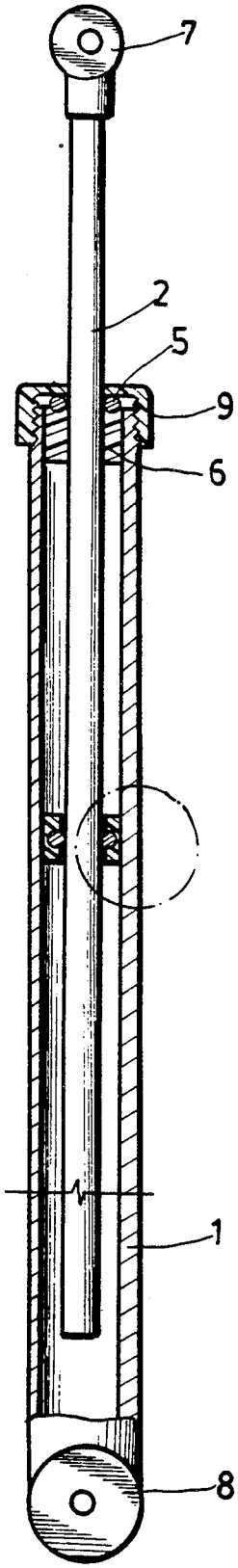
FIGS. 1A and 1B are sectional views of a retractable device for a desk lamp according to the present invention.
Figure 1B:
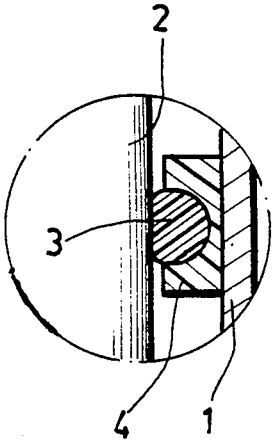

With reference to the drawings and in particular to FIG. 1A thereof, the retractable device for a desk lamp according to the present invention mainly comprises a cylindrical casing 1, a piston rod 2, a first rubber ring 3, an annular member 4, a second rubber ring 5, a plug 6 and a cap 9.

The cylindrical casing 1 is a tubular member and has an end 8 for connecting with an appropriate position of the desk lamp. The piston rod 2 is provided with an outer end 7 for connecting with an appropriate position of the desk lamp and extends into the cylindrical casing 1. The annular member 4 is fixedly mounted within the cylindrical casing 1 for receiving the first rubber ring 3 so that the piston rod 2 is guided by the first rubber ring 3. The plug 6 is mounted at the open end of the cylindrical casing 1. The open end of the cylindrical casing 1 is engaged with the cap 9. The second rubber ring 5 is disposed between the cap 9 and the plug 6. The piston rod 2 extends into the cylindrical casing 1 and supported by the first and second rubber rings 3 and 5.

Figure 2:
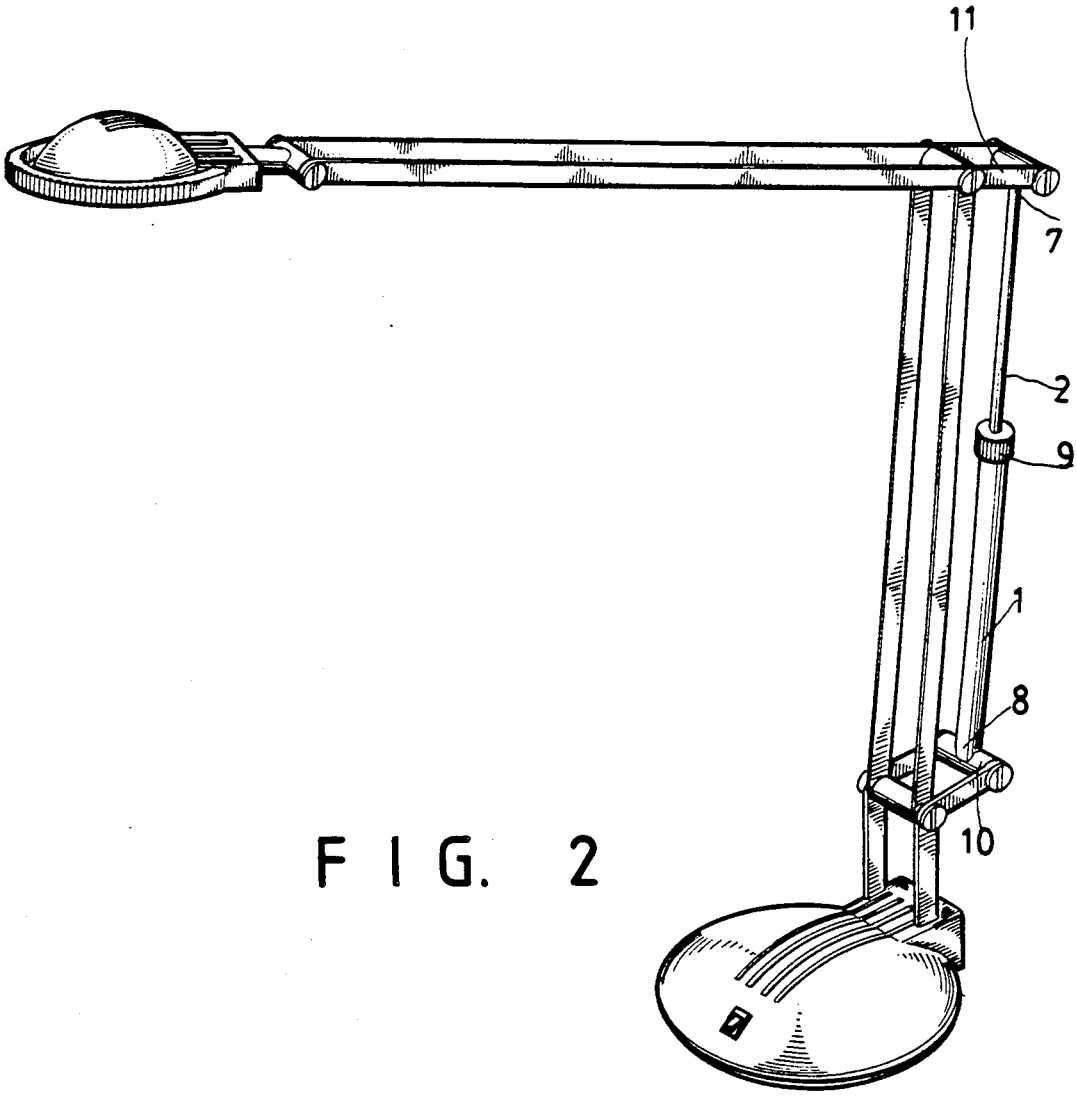
FIG. 2 shows an application of the present invention.
Figure 3:
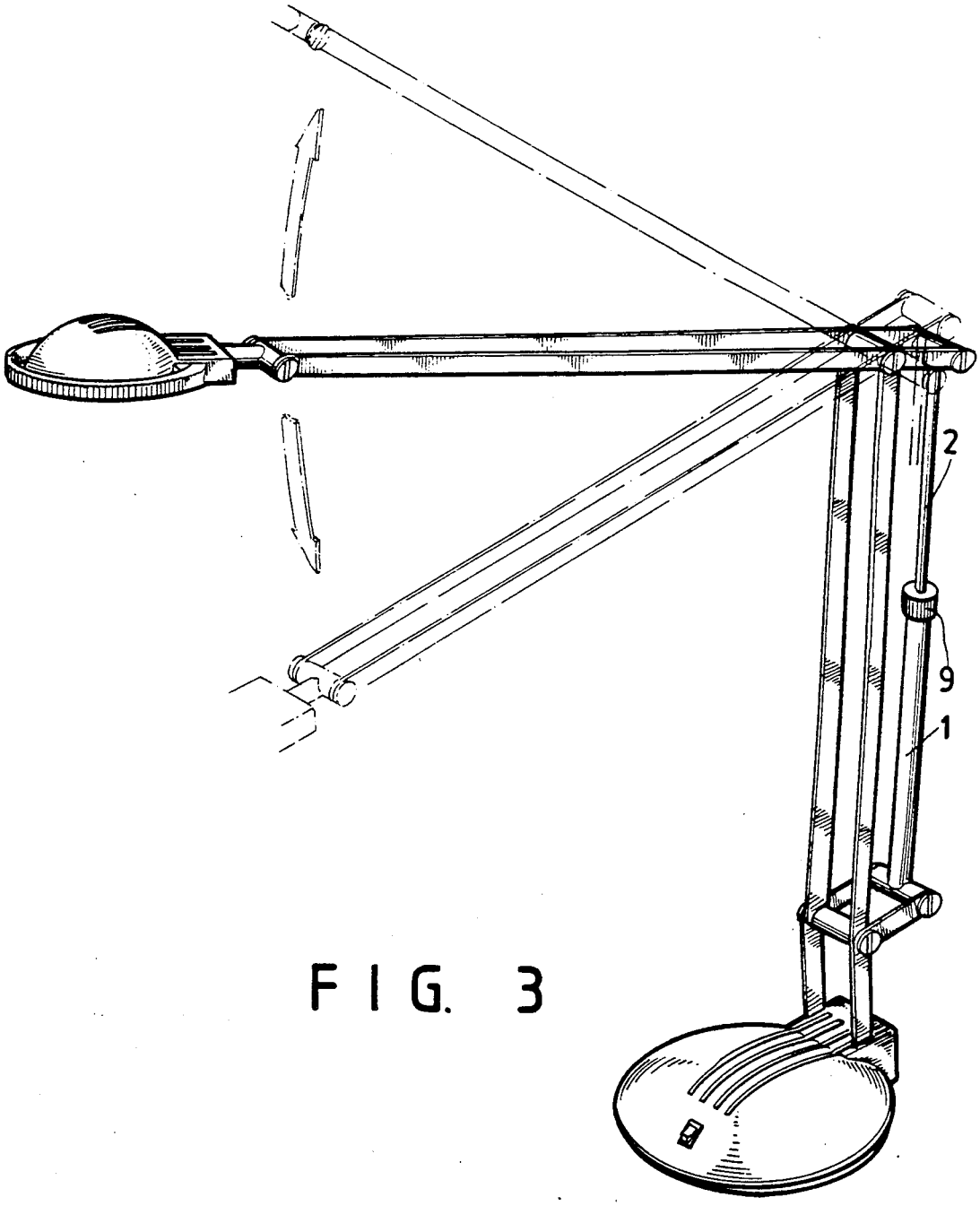
FIG. 3 is a working view of the present invention.

As illustrated in FIG. 2, the lower end 8 of the cylindrical casing 1 is connected with an arm 10 while the upper end 7 of the piston rod 2 is engaged with a support 11. When desired to adjust the height of the shade 12, simply move the shade 12 up or down (see FIG. 3). As the upper end 7 of the piston rod 2 is connected with the arm 11 which is turn connected with the shade 12, the piston rod 2 will be moved upwards when the shade 12 is moved downwards and vice versa. Since the first and second rubber rings 3 and 5 are snugly fitted with the piston rod 2, the piston rod 2 will be kept at a fixed position thereby keeping the shade 12 at a fixed position.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A retractable device for a desk lamp comprising:

a tubular cylindrical casing having an end for connecting with an appropriate position of said desk lamp;

a piston rod provided with an outer end for connecting with an appropriate position of the desk lamp and extending into said cylindrical casing;

an annular ring fixedly mounted within said cylinddrical casing for receiving a first rubber ring;

a cap engaged with the other end of said tubular cylindrical casing;

a plug mounted at the other end of said tubular cylindrical casing; and a second rubber ring disposed between said cap and said plug.

* * * * *